US010920721B2

(12) United States Patent
Kimura et al.

(10) Patent No.: US 10,920,721 B2
(45) Date of Patent: Feb. 16, 2021

(54) INTAKE DUCT FOR INTERNAL COMBUSTION ENGINE

(71) Applicant: TOYOTA BOSHOKU KABUSHIKI KAISHA, Aichi (JP)

(72) Inventors: Ryusuke Kimura, Ichinomiya (JP); Tomoyo Ohno, Nagoya (JP)

(73) Assignee: TOYOTA BOSHOKU KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/533,029

(22) Filed: Aug. 6, 2019

(65) Prior Publication Data

US 2020/0049112 A1 Feb. 13, 2020

(30) Foreign Application Priority Data

Aug. 13, 2018 (JP) ..... 2018-152235

(51) Int. Cl.
*F02M 35/12* (2006.01)
*F02M 35/10* (2006.01)

(52) U.S. Cl.
CPC .. *F02M 35/1272* (2013.01); *F02M 35/10321* (2013.01); *F02M 35/10347* (2013.01); *F02M 35/10354* (2013.01); *F02M 35/10098* (2013.01)

(58) Field of Classification Search
CPC ..... F02M 35/1216; F02M 35/10321; F02M 35/10347; F02M 35/1255; F02M 35/1283; F02M 35/10354
See application file for complete search history.

(56) References Cited

U.S. PATENT DOCUMENTS

2002/0029927 A1* 3/2002 Spannbauer ..... F02M 35/1283 181/214
2011/0100315 A1* 5/2011 Vichinsky ..... F02M 35/112 123/184.53
2012/0292127 A1* 11/2012 Teshima ..... F02M 35/1216 181/224

(Continued)

FOREIGN PATENT DOCUMENTS

JP 3802267 5/2006
JP 2011012581 A * 1/2011

OTHER PUBLICATIONS

Machine translation of JP2011012581A (Year: 2011).*

*Primary Examiner* — Long T Tran
(74) *Attorney, Agent, or Firm* — Greenblum & Bernstein, P.L.C.

(57) ABSTRACT

An intake duct for an internal combustion engine includes a tubular side wall. The side wall includes a first molded body and a second molded body that are separate from each other in a circumferential direction of the side wall. The first molded body includes first and second joints. The second molded body includes first and second joints. The first and second joints of the first molded body and the first and second joints of the second molded body are joined to each other. The first molded body includes a rib protruding toward the second molded body and extending in an axial direction of the side wall. The rib is located inward from the first and second joints of the first molded body. The second molded body includes an accommodation recess that accommodates the rib. The accommodation recess is located outward from the rib.

10 Claims, 3 Drawing Sheets

(56) References Cited

U.S. PATENT DOCUMENTS

| | | | | |
|---|---|---|---|---|
| 2014/0338627 | A1* | 11/2014 | Yamaguchi | F02M 35/1036 123/184.21 |
| 2015/0197149 | A1* | 7/2015 | Hedlund | B60K 13/04 180/309 |
| 2016/0040635 | A1* | 2/2016 | Satarino | F02M 35/10144 285/399 |
| 2018/0195472 | A1* | 7/2018 | Kimura | B01D 46/521 |
| 2018/0274502 | A1* | 9/2018 | Tani | F02B 37/04 |
| 2018/0363599 | A1* | 12/2018 | Itagaki | F02M 35/1233 |

* cited by examiner

INTAKE DUCT FOR INTERNAL COMBUSTION ENGINE

BACKGROUND

1. Field

The following description relates to an intake duct for an internal combustion engine.

2. Description of Related Art

An intake passage for an onboard internal combustion engine includes an intake duct having a tubular side wall (refer to, for example, Japanese Patent No. 3802267). The side wall of the intake duct in the document is divided into two in the circumferential direction, namely, a first segment made of a synthetic plastic molded body and a second segment made of a nonwoven molded body. Flanges are respectively arranged on the opposite ends of the side wall of each of the first segment and the second segment in the circumferential direction. The flange of the first segment includes engagement protrusions that are spaced apart from each other in an integral manner. The flange of the second segment includes through-holes that are spaced apart from each other. The engagement protrusions are respectively engaged with the through-holes to integrally join the first segment to the second segment.

In the intake duct of the document, intake noise may be leaked to the outside through the gaps between the flanges of the first segment and the second segment.

SUMMARY

It is an objective of the present invention to provide an intake duct for an internal combustion engine capable of reducing intake noise.

This Summary is provided to introduce a selection of concepts in a simplified form that are further described below in the Detailed Description, This Summary is not intended to identify key features or essential features of the claimed subject matter, nor is it intended to be used as an aid in determining the scope of the claimed subject matter.

An intake duct for an internal combustion engine that solves the above-described objective includes a tubular side wall. The side wall includes a first molded body and a second molded body that are separate from each other in a circumferential direction of the side wall. The first molded body includes first and second joints respectively located on opposite ends of the first molded body in the circumferential direction. The second molded body includes first and second joints respectively located on opposite ends of the second molded body in the circumferential direction. The first and second joints of the first molded body and the first and second joints of the second molded body are joined to each other. The first molded body includes a rib protruding toward the second molded body and extending in an axial direction of the side wall. The rib is located inward from the first and second joints of the first molded body. The second molded body includes an accommodation recess that accommodates the rib. The accommodation recess is located outward from the rib.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

Figure 1:
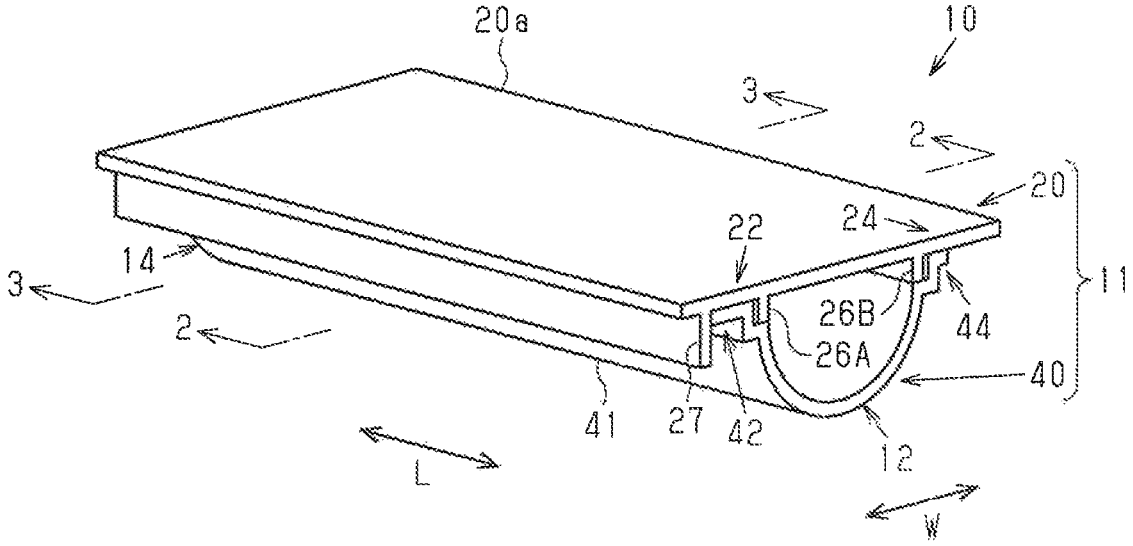
FIG. 1 is a perspective view showing an intake duct for an internal combustion engine according to the present embodiment.

An intake duct for an internal combustion engine (hereinafter referred to as intake duct 10) according to an embodiment will now be described with reference to FIGS. 1 to 3.

As shown in 1, the intake duct 10 includes a semi-tubular side wall 11. The end opening located on the upstream side of the side wall 11 configures an inlet 12, into which intake air is drawn. The end opening located on the downstream side of the side wall 11 configures a connection port 14, which is connected to, for example, an air cleaner.

In the following description, the axial direction and the circumferential direction of the side wall 11 are simply referred to as the axial direction L and the circumferential direction, respectively. Further, the upstream side and the downstream side in the flow direction of intake air in the side wall 11 in the axial direction are simply referred to as the upstream side and the downstream side, respectively.

The side wall 11 includes a first molded body 20, which is made of a hard plastic molded body, and a second molded body 40, which is made of a compression-molded fibrous molded body. The first molded body 20 and the second molded body 40 are formed by dividing the side wall 11 into two in the circumferential direction.

First Molded Body 20

Figure 2:
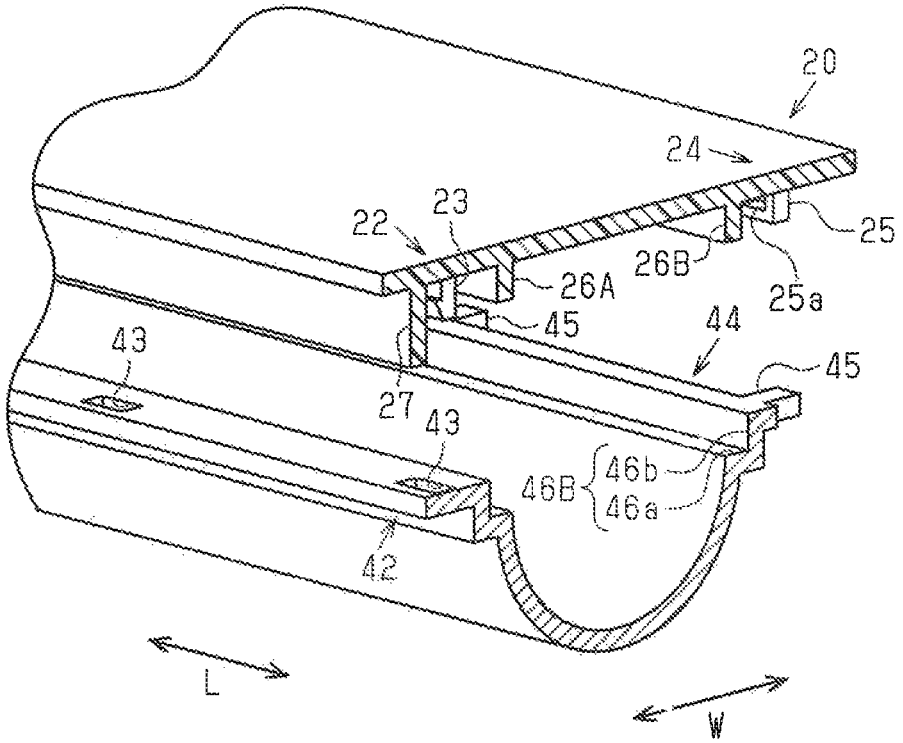
FIG. 2 is an exploded cross-sectional view taken along line 2-2 in FIG. 1, showing a first molded body and a second molded body, which are spaced away from each other.
Figure 3:
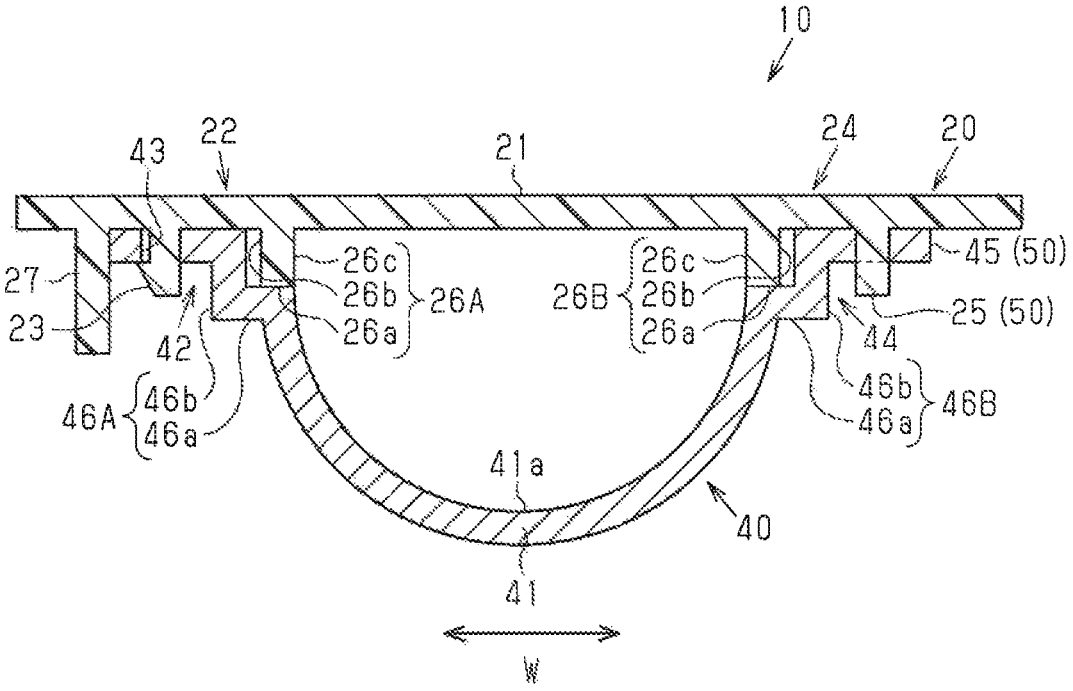
FIG. 3 is a cross-sectional view taken along line 3-3 in FIG. 1.

As shown in FIGS. 2 and 3, the first molded body 20 includes a top wall 20*a*, which has the form of a rectangular plate in a plan view. The top wall 20*a* has long sides extending in the axial direction L.

The direction extending along the short sides of the top wall 20*a* (sideward direction in FIG. 3) is hereinafter referred to as the width direction W.

The middle of the top wall 20*a* in the width direction W is provided with a side wall part 21, which configures part of the side wall 11. Further, the opposite sides of the top wall 20*a* in the width direction W are respectively provided with first and second joints 22 and 24.

Two inner ribs 26A and 26B (first rib and second rib) protrude toward the second molded body 40. The inner ribs 26A and 26B are respectively located inward from the first and second joints 22 and 24 of the top wall 20*a*. The first and second joints 22 and 24 and the inner ribs 26A and 26B extend entirely in the axial direction L of the side wall 11.

As shown in FIGS. 2 and 3, the first joint 22 includes tabs 23, which protrude toward the second molded body 40 and are spaced apart from each other in the axial direction L. An outer rib 27 protrudes toward the second molded body 40. The outer rib 27 is located outward from the tabs 23 of the first joint 22.

The second joint 24 includes arches 25, which protrude toward the second molded body 40 and are spaced apart from each other in the axial direction L. The arches 25 each include a hole 25*a*, which extends through the arch 25 in the width direction W.

Second Molded Body 40

The second molded body 40 includes a side wall part 41, which has the form of a halved tube, and first and second joints 42 and 44, which are respectively arranged on the opposite ends of the side wall part 41 in the circumferential direction and protrude outward.

An accommodation recess 46A (first accommodation recess) is arranged inward from the first joint 42. The accommodation recess 46A is located outward from the inner rib 26A (first rib) and accommodates the inner rib 26A. An accommodation recess 46B (second accommodation recess) is arranged inward from the second joint 44. The accommodation recess 46B is located outward from the inner rib 26B (second rib) and accommodates the inner rib 26B. Each of the accommodation recesses 46A and 46B is formed by bending the corresponding end of the side wall part 41 in the circumferential direction. Each of the accommodation recesses 46A and 46B includes a bottom 46*a*, which extends outward, and a side part 46*b*, which is bent at the outer end of the bottom 46*a* and extends toward the first molded body 20. The joints 42 and 44 and the accommodation recesses 46A and 46B are arranged entirely in the axial direction L.

The first joint 42 opposed to the first joint 22 includes engagement holes 43, with which the tabs 23 are respectively engaged.

The second joint 44 opposed to the second joint 24 includes projections 45, which protrude further outward than other portions of the second joint 44 and are respectively inserted through the arches 25.

The method for assembling the intake duct 10 will now be described.

As shown in FIGS. 2 and 3, to assemble the intake duct 10, each projection 45 of the second molded body 40 is first inserted through the corresponding arch 25 of the first molded body 20. Thus, the first molded body 20 and the second molded body 40 are supported by a hinge mechanism 50, which is configured by the arch 25 and the projection 45. The hinge mechanism 50 serves as a fulcrum to allow the first molded body 20 and the second molded body 40 to be opened and closed.

In this state, the first molded body 20 and the second molded body 40 are moved toward each other. This guides the inner ribs 26A and 26B of the first molded body 20 into the accommodation recesses 46A and 46B of the second molded body 40, respectively. In this manner, the positions of the first molded body 20 and the second molded body 40 are determined, and the tabs 23 of the first molded body 20 are inserted through and engaged with the engagement holes 43 of the second molded body 40. In this state, as shown in FIG. 3, the tip of the first joint 42 of the second molded body 40 is arranged close to the inner surface of the outer rib 27 of the first molded body 20.

With the tabs 23 engaged with the engagement holes 43, tip surfaces 26*a* of the inner ribs 26A and 26B are respectively in contact with bottom parts 46*a* of the accommodation recesses 46A and 46B. Further, there are gaps between outer surfaces 26*b* of the inner ribs 26A and 26B and the side parts 46*b* of the accommodation recesses 46A and 46B. In addition, inner surfaces 26*c* of the inner ribs 26A and 26B are flatly continuous with an inner surface 41*a* of the side wall part 41 of the second molded body 40.

In this manner, the intake duct 10 is assembled by joining the joints 22 and 24 of the first molded body 20 and the joints 42 and 44 of the second molded body 40 to each other.

The fibrous molded body configuring the second molded body 40 will now be described.

The fibrous molded body is made of nonwoven fabric of a PET fiber and nonwoven fabric of core-sheath composite fibers each including, for example, a core (not shown) made of polyethylene terephthalate (PET) and a sheath (not shown) made of denatured PET having a lower melting point than the PET fiber. The denatured PET, which serves as the sheath of the composite fibers, is used as a binder for binding the fibers to each other.

It is preferred that the mixture percentage of denatured PET be 30 to 70%. For example, in the present embodiment, the mixture percentage of denatured PET is 50%.

Such a composite fiber may also include polypropylene (PP) having a lower melting point than PET.

It is preferred that the mass per unit area of the fibrous molded body be 500 to 1500 g/m$^2$. For example, in the present embodiment, the mass per unit area of the fibrous molded body is 800 g/m$^2$.

The second molded body 40 is formed by thermally compressing (thermally pressing) the above-described nonwoven sheet having a thickness of, for example, 30 to 100 mm. In the present embodiment, the thicknesses of the side wall part 41 and the joints 42 and 44 are 1.0 mm.

The present embodiment has the following advantages, (1) The intake duct 10 includes the tubular side wall 11. The side wall 11 includes the first molded body 20 and the second molded body 40, which are separate from each other in the circumferential direction of the side wall 11. The first and second joints 22 and 24 are respectively located on the opposite ends of the first molded body 20 in the circumferential direction. The first and second joints 42 and 44 are respectively located on the opposite ends of the second molded body 40 in the circumferential direction. The first and second joint 22 and 24 of the first molded body 20 and the first and second joints 42 and 44 of the second molded body 40 are joined to each other. The first molded body 20 includes the inner rib 26A (268), which is located inward from the first and second joints 22 and 24 of the first molded body 20. The inner rib 26A (26B) protrudes toward the second molded body 40 and extends in the axial direction of the side wall 11. The second molded body 40 includes the accommodation recess 46A (46B), which is located outward from the inner rib 26A (268) and accommodates the inner rib 26A (268).

In such a structure, the inner rib 26A (268) of the first molded body 20 blocks, from the inner side, the gaps between the joints 22 and 42 (24 and 44) of the first molded body 20 and the second molded body 40. This restricts intake noise from being leaked to the outside through the gaps between the joints 22 and 42 (24 and 44). Further, the inner rib 26A (268) is accommodated in the accommodation recess 46A (46B) of the second molded body 40. This prevents the inner rib 26A (26B) from limiting the intake passage and thus reduces intake noise while limiting an increase in airflow resistance.

(2) The inner rib 26A (first rib) is located inward from the first joint 22 of the first molded body 20. The inner rib 26B (second rib) is located inward from the second joint 24 of the first molded body 20. The accommodation recess 46A (first accommodation recess), which accommodates the inner rib 26A (first rib), is located at the position in the second molded body 40 opposed to the inner rib 26A (first rib). The accommodation recess 46B (second accommodation recess), which accommodates the inner rib 26B (second rib), is located at the position in the second molded body 40 opposed to the inner rib 26B (second rib).

In such a structure, the inner ribs 26A and 26B are respectively arranged on the opposite sides of the first molded body 20 in the circumferential direction, and the accommodation recesses 46A and 46B are respectively arranged on the opposite sides of the second molded body 40 in the circumferential direction. This prevents intake noise from being leaked to the outside from the joints 22 and 42 (24 and 44) on the opposite sides. Accordingly, intake noise is further reduced.

(3) The second molded body 40 is made of a compression-molded fibrous body. The accommodation recess 46A (first accommodation recess) is formed by bending one of the ends of the second molded body 40 in the circumferential direction of the side wall 11, The accommodation recess 46B (second accommodation recess) is formed by bending the other one of the ends of the second molded body 40 in the circumferential direction of the side wall 11.

In such a structure, the second molded body 40 is made of a compressed fibrous molded body. Thus, when the sound waves of intake noise pass through the side wall 11, some of the pressure (sound pressure) vibrates the fibers and is converted into thermal energy. This limits the generation of standing waves of intake noise, thereby reducing intake noise.

Further, the above-described structure facilitates the formation of the accommodation recess 46A (46B) by bending one of the ends of the side wall 11 of the second molded body 40 in the circumferential direction.

(4) The first molded body 20 is made of a plastic molded body, The first joint 22 of the first molded body 20 includes the tabs 23, which protrude toward the second molded body 40. The second joint 42 of the second molded body 40 includes the engagement holes 43, with which the tabs 43 are respectively engaged.

In such a structure, the tabs 23 of the first molded body 20 are engaged with the engagement holes 43 of the second molded body 40 to join the first and second molded bodies 20 and 40 to each other.

When the first molded body 20 and the second molded body 40 are coupled to each other, the inner ribs 26A and 26B of the first molded body 20 are respectively guided into the accommodation recesses 46A and 46B of the second molded body 40 to determine the positions of the first molded body 20 and the second molded body 40. Thus, the tabs 23 of the first molded body 20 can be inserted into and engaged with the engagement holes 43 of the second molded body 40 without accurately adjusting the positions of the tabs 23 and the engagement holes 43.

(5) The tabs 23 are arranged on one of the ends of the first molded body 20 in the circumferential direction. The engagement holes 43 are arranged on one of the ends of the second molded body 40 in the circumferential direction. The hinge mechanism 50 is arranged on the other one of the ends of each of the first molded body 20 and the second molded body 40 in the circumferential direction. The hinge mechanism 50 supports the first molded body 20 and the second molded body 40 to allow the first molded body 20 and the second molded body 40 to be opened and closed. The hinge mechanism 50 includes the arches 25, which are arranged on the first molded body 20, and the projections 45, which are arranged on the second molded body 40 and inserted through the holes 25*a* of the arches 25.

In such a structure, the projections 45 of the second molded body 40 are inserted through the holes 25*a* of the arches 25 of the first molded body 20 to configure the hinge mechanism 50, which supports the first molded body 20 and the second molded body 40 to allow the first molded body 20 and the second molded body 40 to be opened and closed. Thus, when the first molded body 20 and the second molded body 40 are coupled to each other, the hinge mechanism 50 is used to close the first molded body 20 and the second molded body 40. This allows the tabs 23 and the engagement holes 43, which are located on the side opposite from the hinge mechanism 50, to be located close to each other. This also allows the tabs 23 to be inserted into and engaged with the engagement holes 43. Accordingly, the coupling of the molded bodies 20 and 40 to each other is facilitated.

Modifications

The above-described embodiment may be modified as follows. The above-described embodiments and the following modifications can be combined as long as the combined modifications remain technically consistent with each other.

In the above-described embodiment, the tip surfaces 26*a* of the inner ribs 26A and 26B are respectively in contact with the bottom parts 46*a* of the accommodation recesses 46A and 46B. Instead, the tip surfaces 26*a* may be spaced away from the bottom parts 46*a*.

Figure 4:
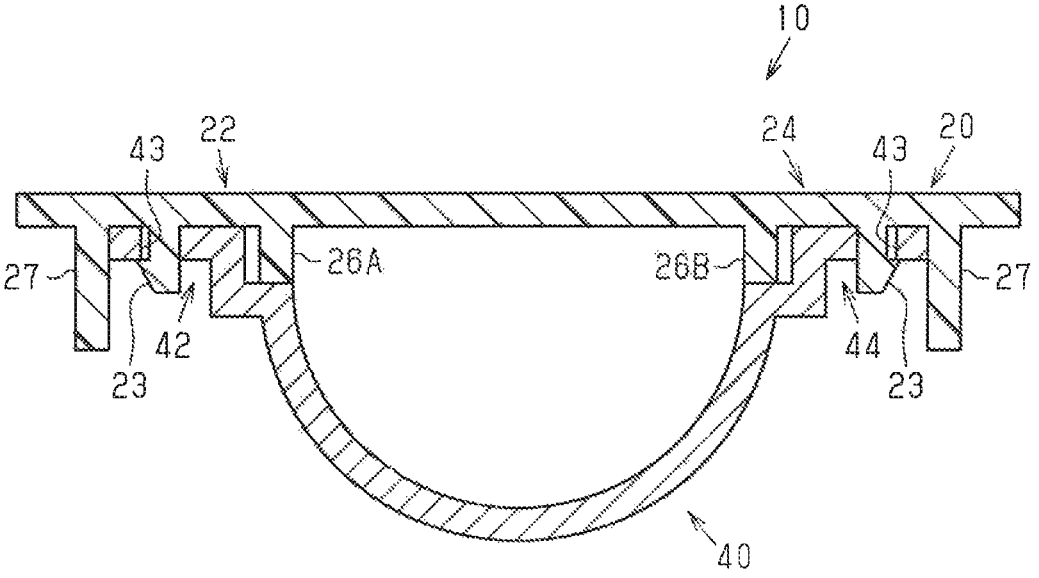
FIG. 4 is a cross-sectional view showing an intake duct according to a modification.

As shown in FIG. 4, the second joint 24 of the first molded body 20 may be shaped in the same manner as the first joint 22, and the second joint 44 of the second molded body 40 may be shaped in the same manner as the first joint 42.

The first joint 42 of the second molded body 40 does not have to protrude outward from the end of the side wall part 41.

Figure 5:
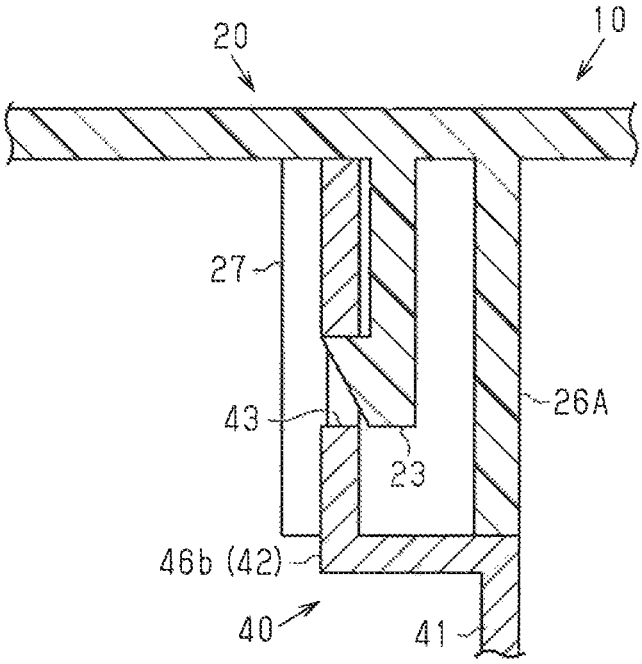
FIG. 5 is a cross-sectional view showing an intake duct according to another modification.

FIG. 5 shows an example of the intake duct 10 according to a modification. In this example, the side part 46*b*, which forms the accommodation recess 46A of the second molded body 40, is provided with the engagement hole 43, with which the tab 23 is engaged. That is, the side part 46*b* forms the first joint 42. The outer rib 27 of the first molded body 20 is located at a position where the tab 23 is not arranged in the axial direction (direction orthogonal to the sheet of the drawing). With the intake duct 10 assembled, it is preferred that the side part 46*b* of the second molded body 40 be pressed inward by the outer rib 27. This limits the separation of the first molded body 20 and the second molded body 40 from each other.

Figure 6:
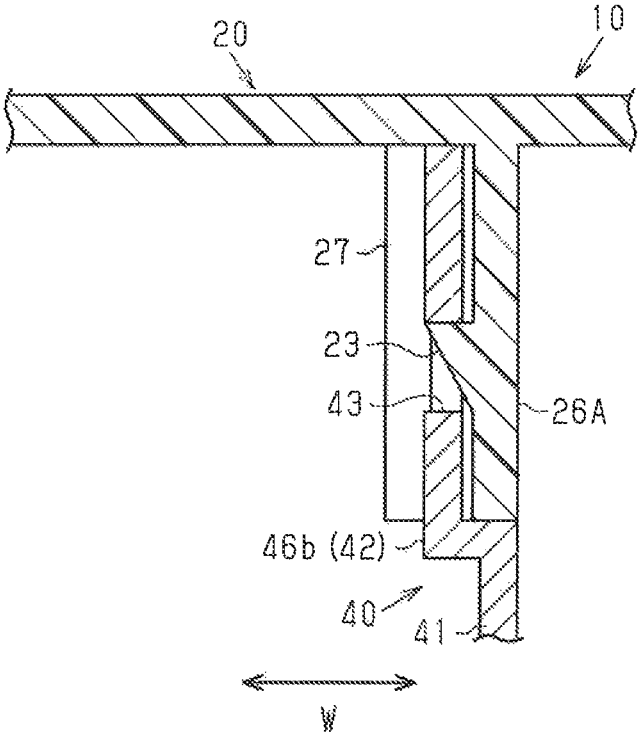
FIG. 6 is a cross-sectional view showing an intake duct according to a further modification.

In the above-described embodiment, the tab 23 and the inner rib 26A are arranged separately in the first molded body 20. Instead, as shown in an intake duct 10 of FIG. 6, the tab 23 may protrude from the outer surface of the inner rib 26A of the first molded body 20. This reduces the size of the intake duct 10 in the width direction W.

Whereas the second molded body 40 may be made of a plastic molded body, the first molded body 20 may be made of a fibrous molded body. In this case, tabs simply need to be arranged on the first joint 42 of the second molded body 40, and engagement holes simply need to be arranged on the first joint 22 of the first molded body 20.

The first molded body and the second molded body may both be made of a fibrous molded body.

The first molded body and the second molded body may both be made of a plastic molded body.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. An intake duct for an internal combustion engine, the intake duct comprising a tubular side wall, wherein the side wall includes a first molded body and a second molded body that are separate from each other in a circumferential direction of the side wall, the first molded body includes first and second joints respectively located on opposite ends of the first molded body in the circumferential direction, the second molded body includes first and second joints respectively located on opposite ends of the second molded body in the circumferential direction, the first and second joints of the first molded body and the first and second joints of the second molded body are joined to each other, the first molded body includes a rib protruding toward the second molded body and extending in an axial direction of the side wall, the rib being located inward from the first and second joints of the first molded body, and the second molded body includes an accommodation recess that accommodates the rib, the accommodation recess being located outward from the rib, wherein the first molded body includes an end in the axial direction, the rib extending from the end in the axial direction.

2. The intake duct according to claim 1, wherein the rib is a first rib arranged inward from the first joint of the first molded body, the accommodation recess is a first accommodation recess arranged at a position in the second molded body opposed to the first rib, the first molded body includes a second rib protruding toward the second molded body and extending in the axial direction, the second rib being located inward from the second joint of the first molded body, and the second molded body includes a second accommodation recess that accommodates the second rib, the second accommodation recess being located outward from the second rib at a position in the second molded body opposed to the second rib.

3. The intake duct according to claim 2, wherein the second molded body is made of a compression-molded fibrous molded body, the first accommodation recess is formed by bending one of the ends of the second molded body in the circumferential direction, and the second accommodation recess is formed by bending the other one of the ends of the second molded body in the circumferential direction.

4. The intake duct according to claim 3, wherein the first molded body is made of a plastic molded body, at least one of the first and second joints of the first molded body includes a tab protruding toward the second molded body, and at least one of the first and second joints of the second molded body includes an engagement hole, the tab being inserted into and engaged with the engagement hole.

5. The intake duct according to claim 4, wherein the tab is arranged on one of the ends of the first molded body in the circumferential direction, the engagement hole is arranged on one of the ends of the second molded body in the circumferential direction, a hinge mechanism is arranged on the other one of the ends of each of the first molded body and the second molded body in the circumferential direction, the hinge mechanism supporting the first molded body and the second molded body to allow the first molded body and the second molded body to be opened and closed, and the hinge mechanism includes an arch arranged on the first molded body and a projection arranged on the second molded body, the projection being inserted through a hole of the arch.

6. An intake duct for an internal combustion engine, the intake duct comprising a tubular side wall, wherein the side wall includes a first molded body and a second molded body that are separate from each other in a circumferential direction of the side wall, the first molded body includes first and second joints respectively located on opposite ends of the first molded body in the circumferential direction, the second molded body includes first and second joints respectively located on opposite ends of the second molded body in the circumferential direction, the first and second joints of the first molded body and the first and second joints of the second molded body are joined to each other, the first molded body includes a rib protruding toward the second molded body and extending in an axial direction of the side wall, the rib being located inward from the first and second joints of the first molded body, and the second molded body includes an accommodation recess that accommodates the rib, the accommodation recess being located outward from the rib, wherein the first molded body includes a top wall opposite sides of the top wall in a width direction of the top wall being respectively provided with the first and second joints of the first molded body, and the rib is located between the first and second joints of the first molded body in the width direction.

7. The intake duct according to claim 6, wherein the top wall includes long sides extending in the axial direction and short sides extending in the width direction.

8. The intake duct according to claim 1, wherein the second molded body is made of a compression-molded fibrous molded body, and the accommodation recess is formed by bending one of the ends of the second molded body in the circumferential direction.

9. An intake duct for an internal combustion engine, the intake duct comprising a tubular side wall, wherein the side wall includes a first molded body and a second molded body that are separate from each other in a circumferential direction of the side wall, the first molded body includes first and second joints respectively located on opposite ends of the first molded body in the circumferential direction, the second molded body includes first and second joints respectively located on opposite ends of the second molded body in the circumferential direction, the first and second joints of the first molded body and the first and second joints of the second molded body are joined to each other, the first molded body includes a rib protruding toward the second molded body and extending in an axial direction of the side wall, the rib being located inward from the first and second joints of the first molded body, and the second molded body includes an accommodation recess that accommodates the rib, the accommodation recess being located outward from the rib, wherein the second molded body is made of a compression-molded fibrous molded body, the accommodation recess is formed by bending one of the ends of the second molded body in the circumferential direction, the first molded body is made of a plastic molded body, at least one of the first and second joints of the first molded body includes a tab protruding toward the second molded body, and at least one of the first and second joints of the second molded body includes an engagement hole, the tab being inserted into and engaged with the engagement hole.

10. The intake duct according to claim 9, wherein the tab is arranged on one of the ends of the first molded body in the circumferential direction, the engagement hole is arranged on one of the ends of the second molded body in the circumferential direction, a hinge mechanism is arranged on the other one of the ends of each of the first molded body and the second molded body in the circumferential direction, the hinge mechanism supporting the first molded body and the second molded body to allow the first molded body and the second molded body to be opened and closed, and the hinge mechanism includes an arch arranged on the first molded body and a projection arranged on the second molded body, the projection being inserted through a hole of the arch.

* * * * *